US007841111B2

(12) United States Patent
Sueshige et al.

(10) Patent No.: US 7,841,111 B2
(45) Date of Patent: Nov. 30, 2010

(54) SHOOTER FOR SNOW REMOVER

(75) Inventors: Hiroshi Sueshige, Wako (JP); Keiji Nagano, Wako (JP); Nobuyuki Hirose, Wako (JP)

(73) Assignee: Honda Motor Co., Ltd. (JP)

( * ) Notice: Subject to any disclaimer, the term of this patent is extended or adjusted under 35 U.S.C. 154(b) by 494 days.

(21) Appl. No.: 11/493,750

(22) Filed: Jul. 26, 2006

(65) Prior Publication Data

US 2007/0022639 A1 Feb. 1, 2007

(30) Foreign Application Priority Data

Jul. 29, 2005 (JP) ..... 2005-220354

(51) Int. Cl.
*E01H 5/09* (2006.01)
*F16F 7/00* (2006.01)

(52) U.S. Cl. ..... 37/260; 267/201

(58) Field of Classification Search ..... 37/260–262; 56/13.3, 16.6; 460/115; 16/308, 342, 347, 16/337; 267/204, 33, 201, 202
See application file for complete search history.

(56) References Cited

U.S. PATENT DOCUMENTS

| | | | | | |
|---|---|---|---|---|---|
| 303,033 | A | * | 8/1884 | Miller | 278/2.1 |
| 1,172,500 | A | * | 2/1916 | Taylor | 16/256 |
| 2,328,121 | A | * | 8/1943 | Bartek | 56/400 |
| 2,650,819 | A | * | 9/1953 | Marlow | 267/284 |
| 2,862,229 | A | * | 12/1958 | Bacca | 16/342 |
| 2,977,159 | A | * | 3/1961 | Shafer et al. | 384/190.3 |
| 3,019,871 | A | * | 2/1962 | Sauzedde | 192/41 R |
| 3,035,859 | A | * | 5/1962 | Born et al. | 292/128 |
| 3,069,149 | A | * | 12/1962 | Neff | 267/33 |
| 3,233,490 | A | * | 2/1966 | Suverkrop | 83/568 |
| 4,532,674 | A | * | 8/1985 | Tobey et al. | 16/295 |
| 4,537,233 | A | * | 8/1985 | Vroonland et al. | 141/387 |
| 4,761,901 | A | * | 8/1988 | Szafarz | 37/262 |
| 5,029,940 | A | * | 7/1991 | Golynsky et al. | 297/300.4 |
| 5,240,319 | A | * | 8/1993 | Koga | 312/319.2 |
| 5,566,048 | A | * | 10/1996 | Esterberg et al. | 361/679.27 |
| 5,979,151 | A | * | 11/1999 | Sanders et al. | 56/60 |

(Continued)

FOREIGN PATENT DOCUMENTS

| | | |
|---|---|---|
| JP | 56040898 | 8/1979 |

(Continued)

*Primary Examiner*—Thomas B Will
*Assistant Examiner*—Abigail A Risic
(74) *Attorney, Agent, or Firm*—Adams & Wilks

(57) ABSTRACT

A shooter for a snow remover has a shooter main body configured to be rotatably mounted on an auger housing of a snow remover for ejecting snow collected by an auger of the snow remover. A shooter guide is swingably mounted on a top end of the shooter main body to undergo swinging movement from an initial state thereof so as to allow adjustment of an angle of projection of the snow ejected from the shooter main body. A torsion spring has a single coil and is connected between the shooter main body and the shooter guide for urging the shooter guide to return to the initial state thereof. Vibration-reducing members are inserted into the single coil of the torsion spring so as to be in physical contact with one another and to surround and support an entire inner periphery of the single coil for reducing vibration and deformation in a radial direction of the torsion spring.

22 Claims, 13 Drawing Sheets

U.S. PATENT DOCUMENTS

| | | | | |
|---|---|---|---|---|
| 6,170,178 | B1 * | 1/2001 | Christy | 37/231 |
| 6,609,272 | B1 * | 8/2003 | Lee | 16/307 |
| 2002/0084614 | A1 * | 7/2002 | Chun | 280/124.147 |
| 2006/0277719 | A1 * | 12/2006 | Wang | 16/342 |

FOREIGN PATENT DOCUMENTS

| | | |
|---|---|---|
| JP | 01355216 | 12/2001 |

* cited by examiner

60

62
61A
112
61
97
95
63
64
87c
111
94
77
65
61
62
43
78

SHOOTER FOR SNOW REMOVER

FIELD OF THE INVENTION

The present invention relates to a shooter for a snow remover, and particularly relates to a shooter that is improved so that a shooter guide is swingably mounted on a distal end of a shooter main body, whereby snow that has collected in an auger can be ejected in an arbitrary direction.

BACKGROUND OF THE INVENTION

Generally, a shooter for a snow remover is designed so that a single-step or double-step shooter guide is swingably mounted on the distal end of the shooter, and snow that has collected in an auger is ejected in an arbitrary direction.

Japanese Utility Model Publication No. 56-40898 and Japanese Laid-Open Patent Publication No. 2001-355216 disclose a shooter for a snow remover that is designed so that a shooter guide is bendably mounted on a distal end of a shooter, and a recoil means is provided between the shooter and the shooter guide for returning the shooter guide to its initial state. The shooter for a snow remover disclosed in Japanese Utility Model Publication No. 56-40898 will be used as an example and described with reference to FIG. 12 hereof.

The shooter 200 shown in FIG. 12 includes a first shooter guide 202 swingably mounted on the distal end of a shooter main body 201, and a second shooter guide 203 swingably mounted on the distal end of the first shooter guide 202. A tension spring 204 is provided between the shooter main body 201 and the first shooter guide 202 to allow the first shooter guide 202 to return to its original position. An operating wire 205 extends from the first shooter guide 202. Pulling the operating wire 205 causes the first and second shooter guides 202, 203 to swing and bend in relation to the shooter main body 201. Releasing the operating wire 205 allows the tension spring 204 to return the first and second shooter guides 202, 203 to their initial positions.

However, since the shooter 200 uses the tension spring (coil spring) 204 as the recoil means, an assembly operation is required in which the tension spring 204 is stretched between the shooter main body 201 and the first shooter guide 202. Stretching the recoiling tension spring 204 between the shooter main body 201 and the first shooter guide 202 in this manner is a complicated operation, and it is preferable that the assembly operation be simplified.

Furthermore, in the shooter 200 described above, the recoiling tension spring 204 is provided between the shooter main body 201 and the first shooter guide 202, and the tension spring 204 therefore resonates and increases the noise of the shooter 200. It is thus preferable that the resonating of the tension spring 204 provided between the shooter main body 201 and the first shooter guide 202 be improved to make the shooter quieter.

SUMMARY OF THE INVENTION

The present invention, in one aspect, provides a shooter for a snow remover, which comprises a shooter main body, designed to be rotatably mounted on an auger housing of a snow remover, for ejecting to a significant distance snow collected by an auger of the snow remover; a shooter guide swingably mounted on the top end of the shooter main body in such a manner as to allow adjustment of an angle of snow projection; a torsion spring located between the shooter main body and the shooter guide for urging the shooter guide to return to the initial state; and vibration-reducing members fitted into a coil of the torsion spring for reducing vibration in the torsion spring.

Since a torsion spring is used as means for returning the shooter guide in this manner, the vibration in the coil of the torsion spring is greatly reduced compared to the prior art cases in which a tension coil spring is used. Furthermore, deformation and vibration in the torsion spring are further reduced by the vibration-reducing members fitted into the coil, resulting in a superbly quiet shooter.

Preferably, the shooter guide comprises a first shooter guide swingably mounted on the top end of the shooter main body, a second shooter guide swingably mounted on the top end of the first shooter guide, and a plate link rotatably mounted on both the shooter main body and the second shooter guide. The second shooter guide, which is swingably mounted on the first shooter guide, can therefore be swung in a linked manner by operating the first shooter guide.

The plate link is preferably disposed on the side surfaces of the shooter main body and the shooter guide. Therefore, the area surrounding the shooter main body and the shooter guide is simplified, and the outward appearance of the shooter is improved.

It is preferable that the shooter main body have a bracket mounted on the top end for mounting the torsion spring, that one interlocking part of the torsion spring be interlocked with the bracket, and that the other interlocking part of the torsion spring be interlocked with the plate link.

It is preferable that the bracket have a substantial U shape and be configured from a bottom part and left and right-side parts, and that the torsion spring be mounted on the bracket by inserting the vibration-reducing members through the left and right-side parts in a state in which the torsion spring is located between the left and right-side parts. Thus, the torsion spring is located between the left and right-side parts of the bracket, causing vibration in the axial and longitudinal directions of the torsion spring to be restricted by the left and right-side parts, and vibration in the torsion spring to be reduced.

The plate link preferably has a stopper that interlocks with the bracket so that the plate link is prevented from rotating when the other interlocking part of the torsion spring is disengaged from the plate link in a state in which the torsion spring is not loaded. Therefore, interlocking is simplified and the torsion spring is easier to assemble because the plate link is held in a fixed position when the other interlocking part of the torsion spring interlocks with the plate link.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
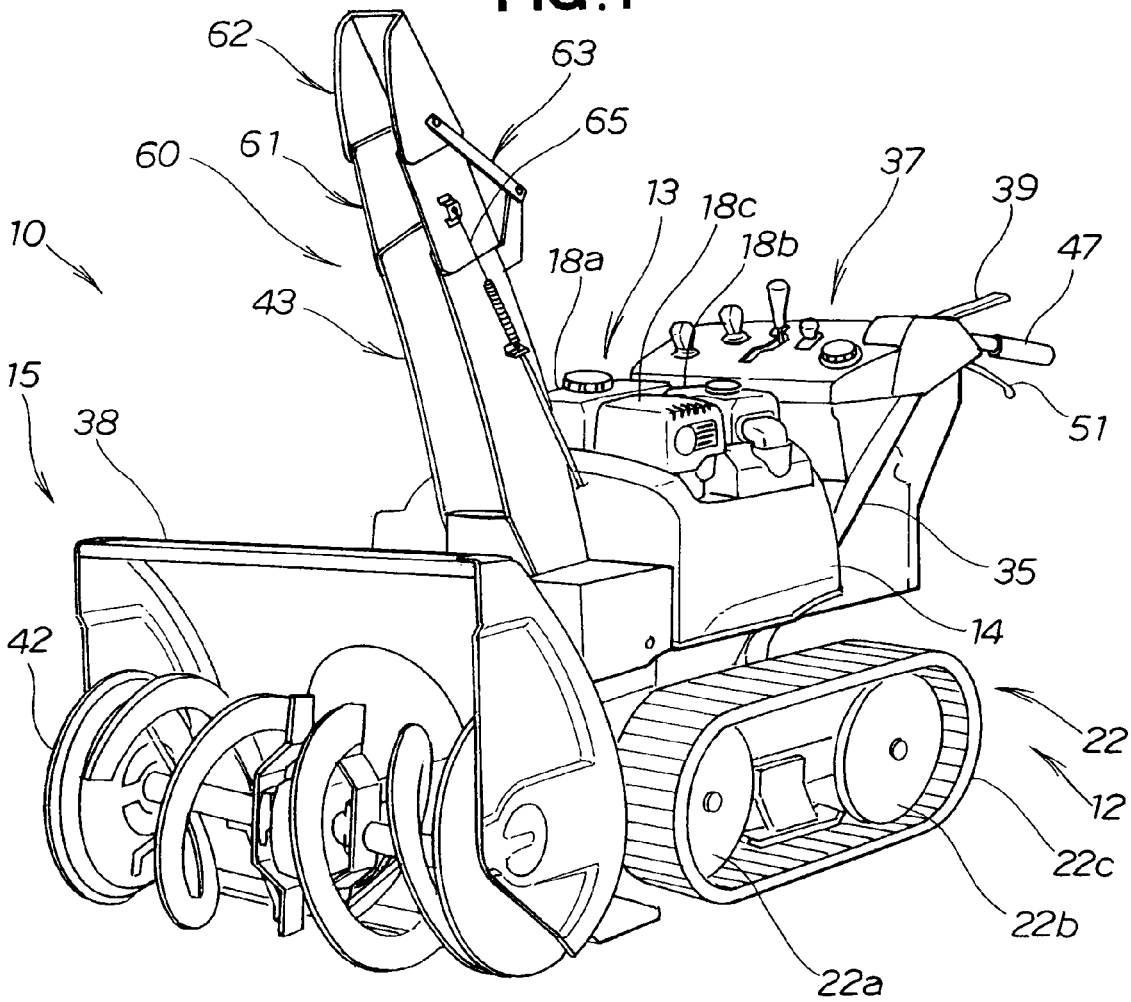
FIG. 1 is a perspective view of a snow remover that has the shooter of the present invention.
Figure 2:
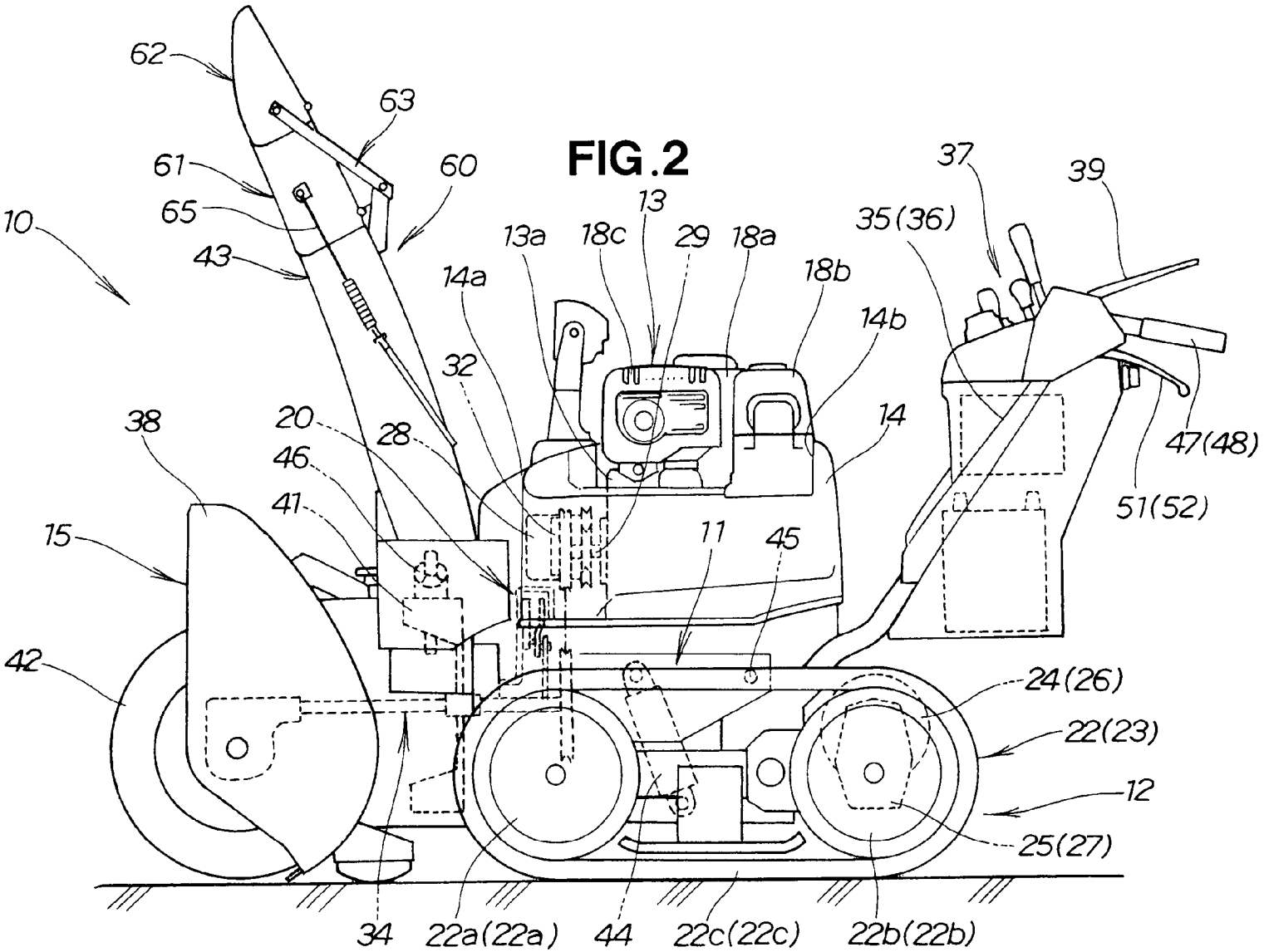
FIG. 2 is a side view of the snow remover shown in FIG. 1.

A snow remover 10 shown in FIGS. 1 and 2 comprises a frame body 11, a propulsion unit 12 provided underneath the frame body, and an engine 13 mounted on the frame body 11. The engine 13 is the drive source of the propulsion unit 12 and is protected by an engine cover 14. A rotary snow-removing unit (snow-removing unit) 15 for collecting snow is provided on the front of the frame body 11 in front of the engine cover 14, so as to be capable of tilting to the left and right in relation to the frame body 11. The snow collected in the snow-removing unit 15 is ejected by means of a shooter 60 that is rotatably provided on the frame body 11.

Left and right operating handles 35, 36 extend from the top of the frame body 11 so as to be inclined upward and to the rear. An operating panel 37 is provided between the left and right operating handles 35, 36. The left and right operating handles 35, 36 have grips 47, 48 that are grasped by the operator. The snow remover 10 described above is a self-propelled traveling snow remover.

The propulsion unit 12 includes left and right propelled parts 22, 23, left and right electric motors 24, 26, and left and right decelerators 25, 27. The left and right electric motors 24, 26 are driven by electricity from a power generator 28, which propels the left and right propelled parts 22, 23. Therefore, the speed of the left and right propelled parts 22, 23 is regulated by adjusting the rotational speed of the electric motors 24, 26.

The power generator 28 is driven by the engine 13 to generate electricity, and the electricity is fed to the left and right electric motors 24, 26 to drive the motors 24, 26. Therefore, the engine 13 serves as the drive source for the propelled parts 22, 23.

The engine cover 14 is provided on top of the frame body 11. A front end 14*a* of the engine cover 14 extends to the front of the frame body 11. The engine cover 14 has an opening 14*b* formed in the middle. A fuel tank 18*a*, an air cleaner 18*b*, and a muffler 18*c* protrude upward from the opening 14*b*. The front end 14*a* of the engine cover 14 covers a tilt detection means 20 for detecting the tilt of the rotary snow-removing unit 15 to the left and right.

The left propelled part 22 is composed of a front rotating wheel 22*a*, a back driving wheel 22*b*, and a crawler belt 22*c* passed over these two wheels, wherein the driving wheel 22*b* is propelled to rotate forwards and backwards by the left electric motor 24.

The right propelled part 23 is symmetrical to the left propelled part 22, the structural components thereof are denoted by the same numerical symbols, and descriptions thereof are omitted.

In the rotary snow-removing unit 15, an output axle 29 of the engine 13 is coupled with a drive axle 34 via an electromagnetic clutch 32. The drive axle 34 is extended into an auger housing 38 and is coupled with a blower 41 and an auger 42. A shooter main body 43 is rotatably provided on top of the auger housing 38.

The left operating handle 35 has a propulsion-enabling lever 39 and a left-turn lever 51. The propulsion-enabling lever 39 is grasped to allow the snow remover to be propelled, and is released to halt propulsion. The left-turn lever 51 controls the rotation of the left electric motor 24. The right operating handle 36 has a right-turn lever 52 for controlling the rotation of the right electric motor 26.

The snow remover 10 further includes a height adjustment cylinder 44 for adjusting the height of the auger 42, and a tilting cylinder 46 for tilting the rotary snow-removing unit 15. Electrohydraulic cylinders may, for example, be used as the height adjustment cylinder 44 and the tilting cylinder 46.

The frame body 11 is caused to swing vertically around a supporting axle 45 by operating the height adjustment cylinder 44. The rotary snow-removing unit 15 is provided on the front of the frame body 11, and the height of the rotary snow-removing unit 15 can be adjusted by swinging the frame body 11 vertically. Operating the tilting cylinder 46 causes the rotary snow-removing unit 15 to tilt to the left and right in relation to the frame body 11.

When the snow remover 10 is used to remove snow, the operator grasps the left and right grips 47, 48 with the left and right hands and propels the frame body 11 forward. Snow is collected within the auger 42 while the frame body 11 is moved forward, the collected snow is thrown upward by the blower 41, and the snow thrown upward is projected out by the shooter 60.

Figure 3:
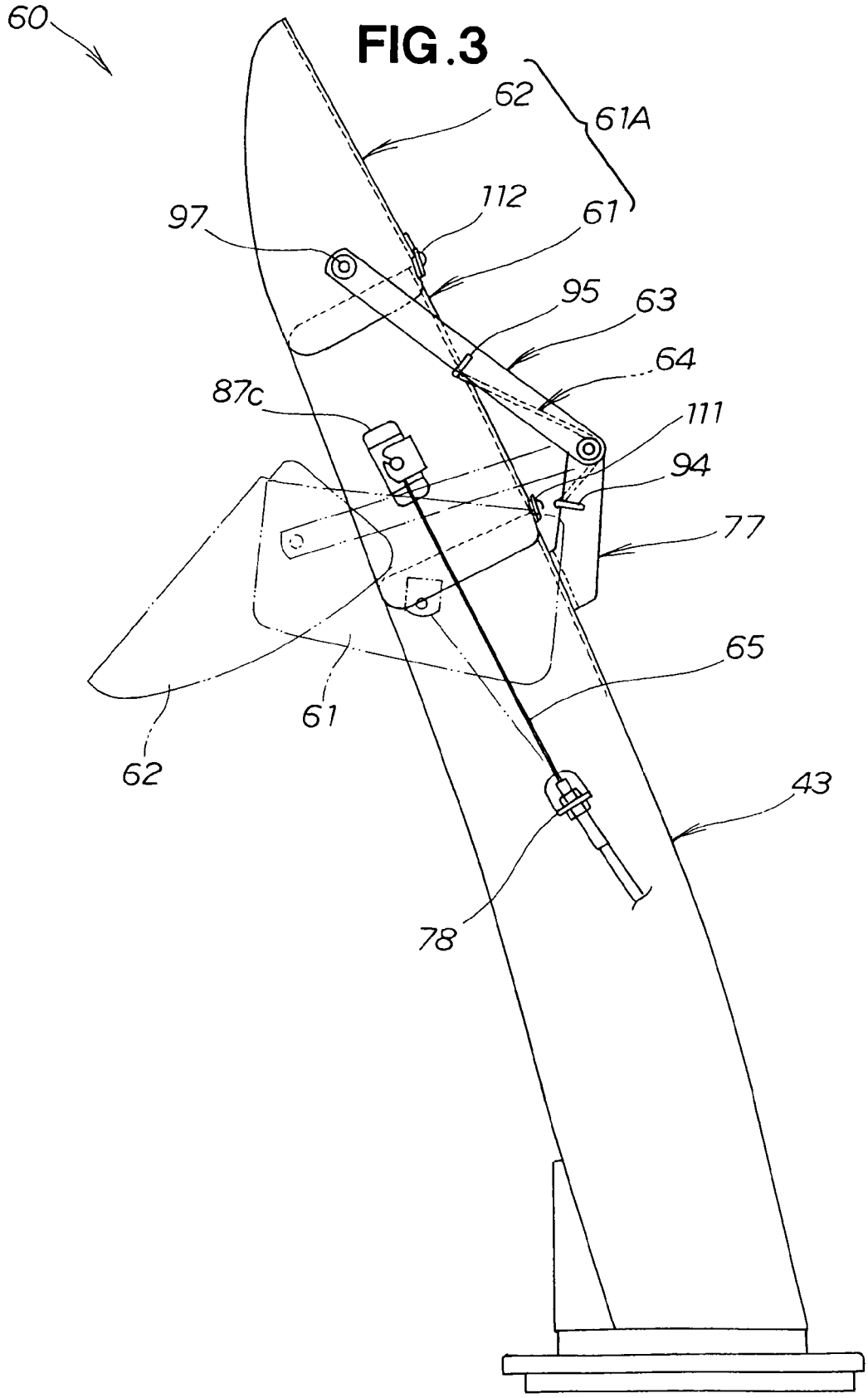
FIG. 3 is an enlarged view of the shooter shown in FIG. 2.
Figure 4:
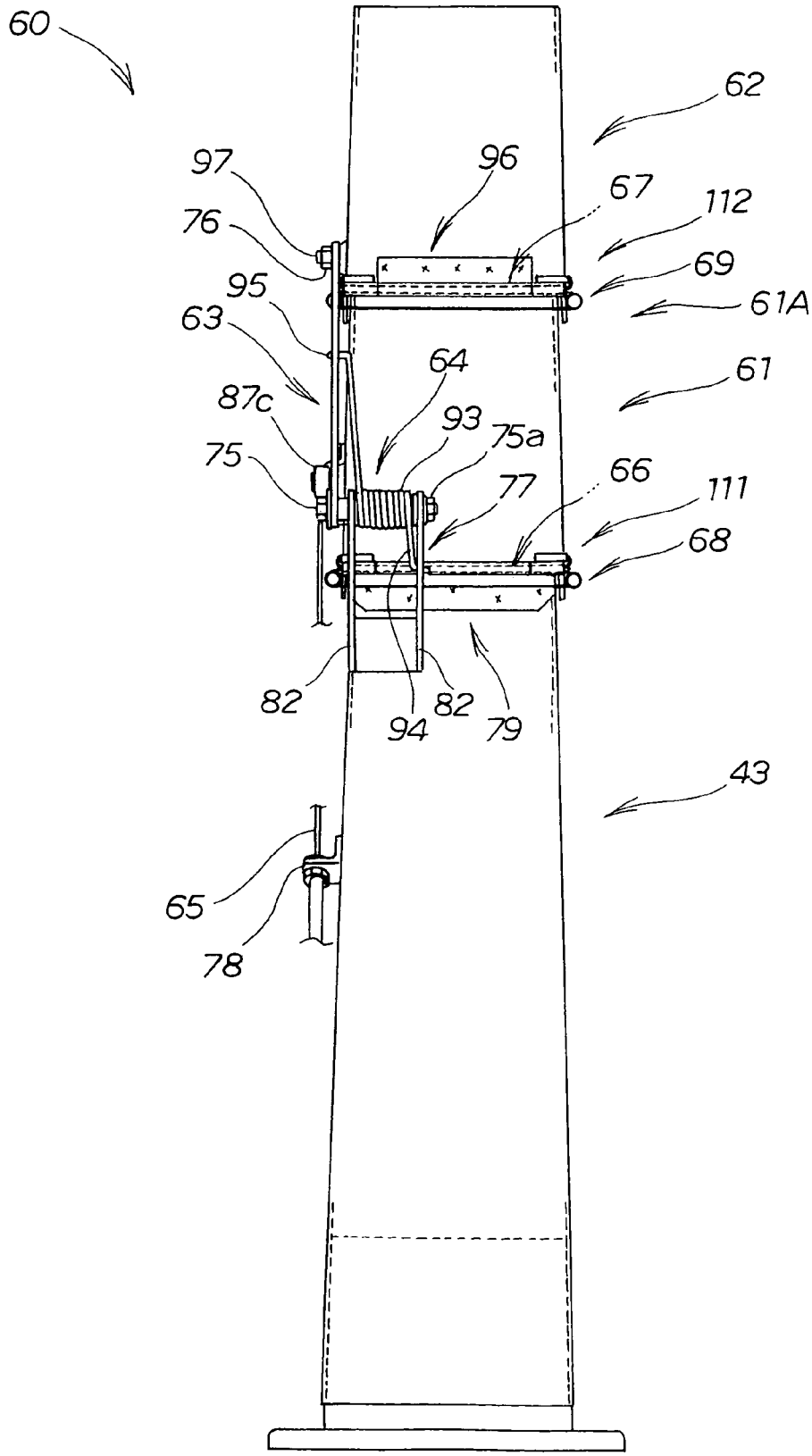
FIG. 4 is a rear view of the shooter shown in FIG. 3.

As shown in FIGS. 3 and 4, the shooter 60 includes the shooter main body 43 mounted on the top surface near the left (in FIG. 2) of the auger housing 38, a first shooter guide 61 that is swingably mounted so as to bend around the top end of the shooter main body 43 to change the angle of snow projection, a second shooter guide 62 that is swingably mounted so as to bend around the top end of the first shooter guide 61, a plate link 63 that extends between the shooter main body 43 and the second shooter guide 62, a torsion spring 64 that is located between the shooter main body 43 and the plate link 63, and an operating wire 65 for operating the first and second shooter guides 61, 62.

A shooter guide 61A is configured from the first shooter guide 61 and the second shooter guide 62. The torsion spring 64 is a member that returns the second shooter guide 62 to its initial position by means of the plate link 63.

Pulling the operating wire 65 causes a downward operating force to act on a mounting unit 87*c* of the first shooter guide 61 on which the distal end of the operating wire 65 is mounted. The first shooter guide 61 rotates around a first hinge 111 in the counterclockwise direction (downward) in FIG. 3. Since the shooter main body 43 and the second shooter guide 62 are both rotatably coupled with the plate link 63 at this time, the second shooter guide 62 also rotates downward around a second hinge 112 along with the rotation of the first shooter guide 61. Therefore, the first and second shooter guides 61, 62 are curved in relation to the shooter main body 43, as shown by the double-dashed lines.

The shooter 60 is designed so that a bracket 77 is provided near the side of the reverse surface of the shooter main body 43; the plate link 63 is provided on the side surfaces of the shooter main body 43 and the first and second shooter guides 61, 62; the torsion spring 64 located between the bracket 77 and the plate link 63 is disposed near the side of the shooter main body 43; and the operating wire 65 is positioned on the side surfaces of both the shooter main body 43 and the first shooter guide 61. The area around the shooter main body 43 can therefore be simplified. As a result, the outward appearance of the area around the shooter main body 43 is improved.

Figure 5:
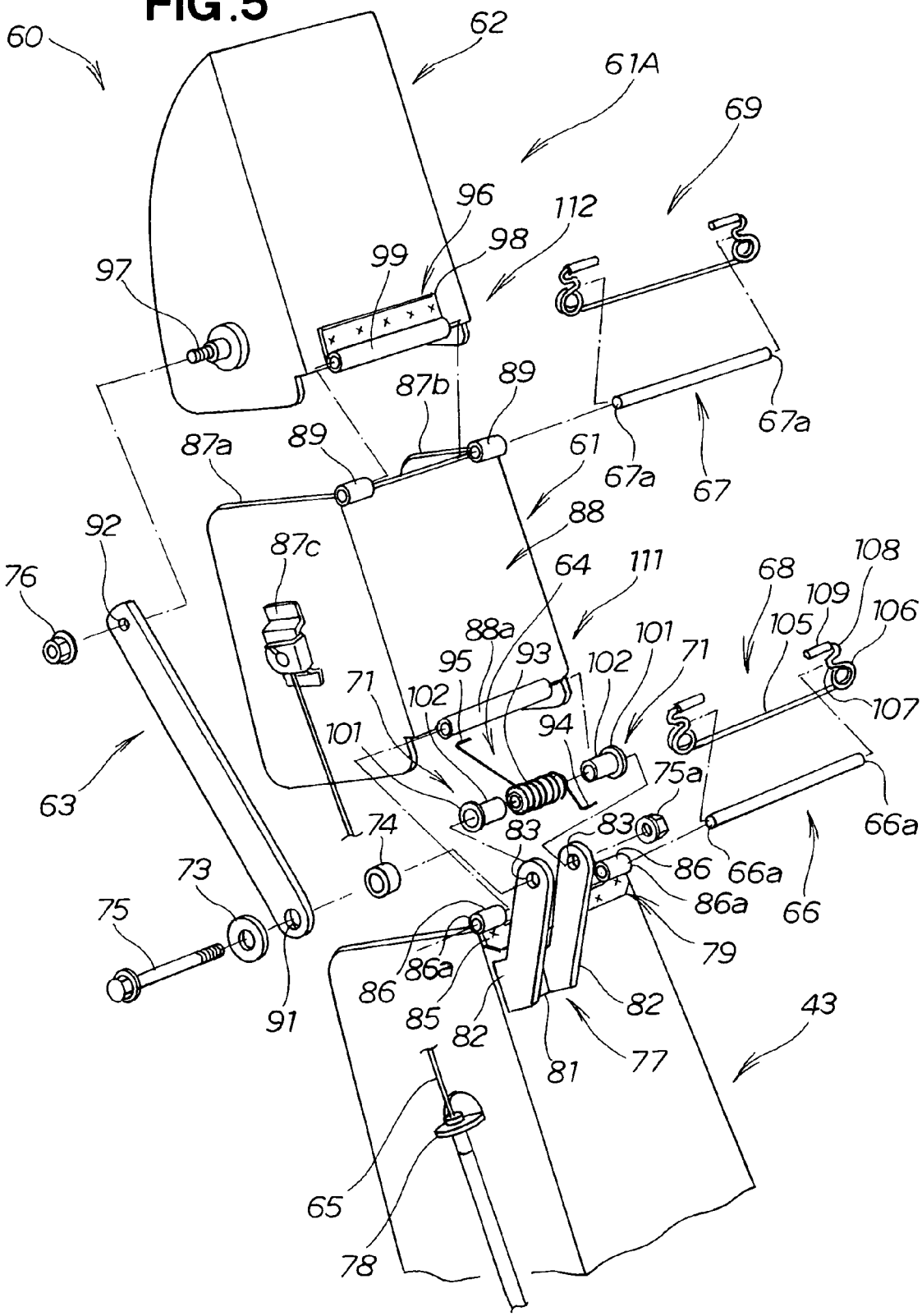
FIG. 5 is an exploded perspective view of a shooter apparatus.

The shooter main body 43 includes the bracket 77, a stay 78, and a hinge half 79 on the side of the shooter main body, as shown in FIG. 5. The bracket 77 supports one end of the plate link 63, and also supports the coil 93 of the torsion spring 64. The stay 78 is formed on the side surface of the shooter main body 43 in order to support the operating wire 65. The hinge half 79 on the side of the shooter main body 43 is mounted on the top end of the shooter main body 43.

The hinge half 79 on the side of the shooter main body is made from a separate member and includes a bonding plate 85 that is spot-welded to the shooter main body 43, and external tubular parts 86, 86 whose top ends are formed so as to curl away from the bonding plate 85 to allow a pin member 66 to be inserted and used to hold an interlocking member 68.

The first shooter guide 61 has the shape of a U in cross section and is composed of a reverse-side plate 88 that forms part of a hinge, and left and right side plates 87*a*, 87*b* that are formed to bend around the sides of the reverse-side plate 88.

The reverse-side plate 88 includes a central tubular part 88*a* formed so that the bottom end curls in the middle towards the shooter main body 43, and external tubular parts 89, 89 formed so that the top ends are both curled. The central tubular part 88*a* of the reverse-side plate 88 constitutes the hinge half on the side of the shooter guide.

The mounting unit 87*c* for mounting the distal end of the operating wire 65 is located on the side surface of the left side plate 87*a*.

The shooter main body 43 and the first shooter guide 61 are coupled via the pin member 66 and the central tubular part 88*a*. The interlocking member 68 is set into both ends of the pin member 66, whereby the pin member 66 is prevented from coming loose from the external tubular parts 86, 86 and the central tubular part 88*a*. The interlocking member 68 is engaged with the outer ends 86*a*, 86*a* of the external tubular parts 86, 86.

The second shooter guide 62 is formed into a U shape in cross section and includes a hinge half 96 that is fixed in place in the middle of the bottom end thereof by welding. Furthermore, the side surface of the second shooter guide 62 has a stud bolt 97 provided in order to rotatably support the other end of the plate link 63.

The hinge half 96 is composed of a bonding plate 98 that is spot-welded onto the second shooter guide 62, and a central tubular part 99 formed so as to curl away from the bonding plate 98.

The first and second shooter guides 61, 62 are coupled via a pin member 67 that is inserted through the external tubular parts 89, 89. An interlocking member 69 is set at both ends of the pin member 67, whereby the pin member 67 is prevented from coming loose from the external tubular parts 89, 89 and the central tubular part 99.

A bolt through-hole 91 for enabling the plate link 63 to be rotatably mounted on the shooter main body 43 is formed in one end of the plate link 63. A stud through-hole 92 through which the stud bolt 97 is inserted is formed in the other end of the plate link 63. One end of the plate link 63 is rotatably supported on the shooter main body 43 by a bolt 75. The other end is fastened with a nut 76 by passing the stud bolt 97 through the stud through-hole 92, so that this other end is rotatably supported on the second shooter guide 62.

Since the first shooter guide 61 and the second shooter guide 62 are moved in conjunction with each other by the plate link 63, it is possible to simultaneously operate the second shooter guide 62 by operating the first shooter guide 61.

The torsion spring 64 is composed of a coil 93 supported by the bolt 75 via two collars (first and second collars) 71, 71; an (first) interlocking part 94 that engages with the bracket 77 of the shooter main body 43; and another (second) interlocking part 95 that engages with the plate link 63. The torsion spring 64 is located between the plate link 63 and the shooter main body 43. The spring constantly urges the second shooter guide 62 in the return direction. The coil 93 of the torsion spring 64 allows the collars 71, 71 to be inserted from both ends.

The operating wire 65 is fastened to the first shooter guide 61 at the distal end. The wire extends from the shooter guide 61 through the shooter main body 43 to the side of the frame body 11 (FIG. 2) and operates the first and second shooter guides 61, 62.

The collars 71 are formed from a resin or rubber-based material. These collars 71 are composed of a flange 101 that is in contact with the end of the coil 93, and tubular bodies 102 that are inserted into the coil 93. The tubular bodies 102 support the inner periphery of the coil 93. Specifically, the collars 71, 71 are vibration-reducing members that reduce vibration and deformation in the radial direction of the torsion spring 64. The bolt 75 supports the collars 71, 71 by being inserted into the collars 71, 71 via a washer 73, the plate link 63, and a spacer 74. The bolt 75 is fastened with a nut 75*a*.

The bracket 77 is formed into a substantial U shape and is composed of a bottom part 81 that is spot-welded onto the shooter main body 43, and left- and right-side parts (members) 82, 82 that extend from both ends of the bottom part 81. The left- and right-side parts 82, 82 have through-holes 83, 83 formed to allow the bolt 75 to be inserted.

The first hinge 111 is configured from the hinge half 79 on the side of the shooter main body, the central tubular part 88*a* of the reverse-side plate 88, the pin member 66, and the interlocking member 68. The second hinge 112 is configured from the external tubular parts 89, 89 of the reverse-side plate 88, the curled hinge half 96, the pin member 67, and the interlocking member 69.

Figure 6:
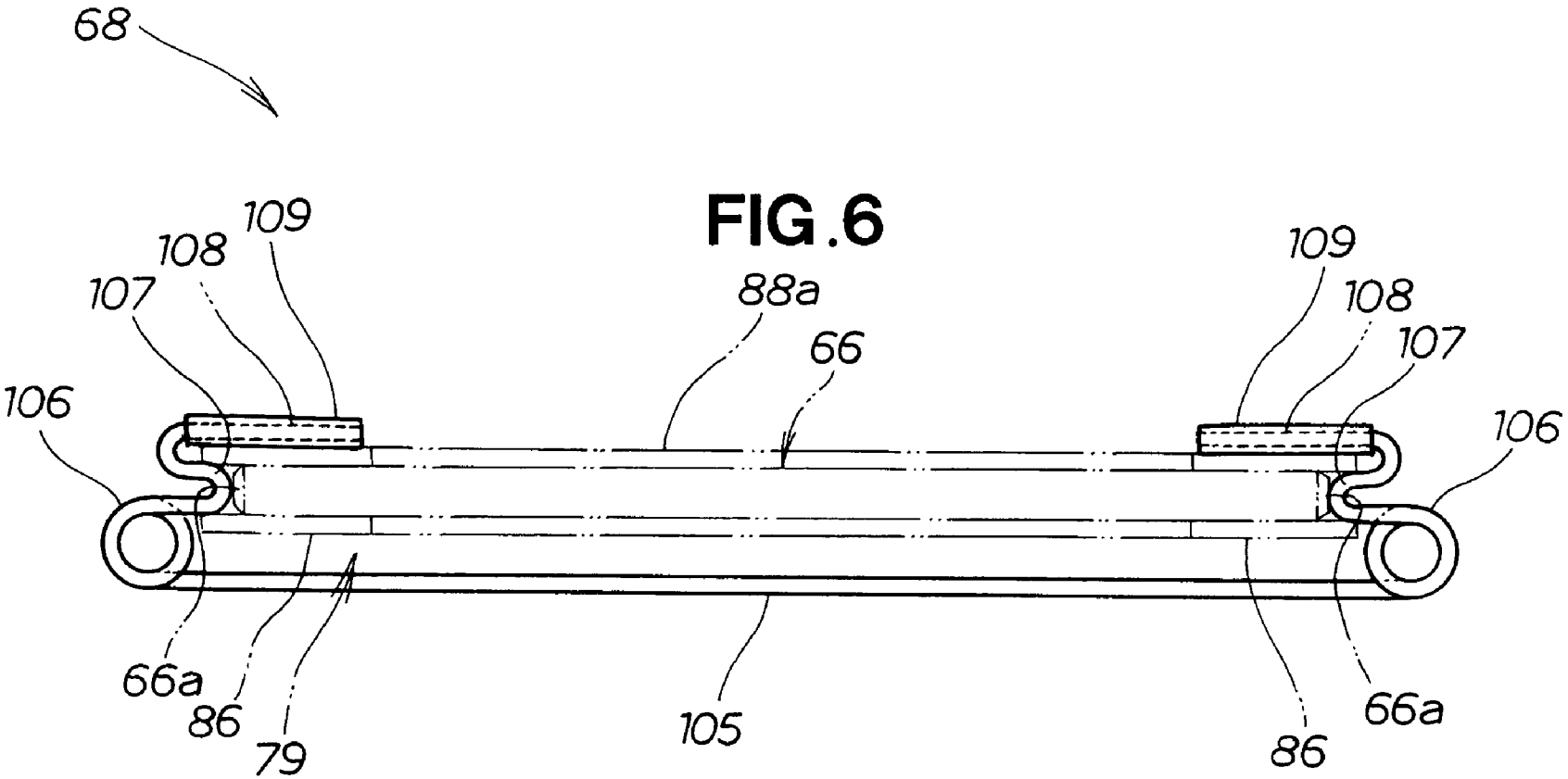
FIG. 6 is a plan view of the interlocking member shown in FIG. 5.

The interlocking member (spring press) 68 is formed with an elastic wire material, as shown in FIG. 6. The interlocking member 68 has a rectilinear part 105 positioned either on the side of the shooter main body 43 or on the side of the first shooter guide 61; coils 106, 106 formed at both ends of the rectilinear part 105; pressure parts 107, 107 that apply pressure to the ends 66*a*, 66*a* of the pin member 66, and which are formed by bending the coils 106, 106 into substantial U shapes towards the center of the rectilinear part 105; contact parts 108, 108 that are formed by being bent from the pressure parts 107, 107 further towards the center of the rectilinear part 105; and tubes 109, 109 that are mounted on the contact parts 108, 108. The pressure parts 107, 107 are engaged with the external tubular parts 86, 86 of the hinge half 79 on the side of the shooter main body.

The pin member 66 is formed to be smaller in length than the external tubular parts 86, 86 of the hinge half 79 on the side of the shooter main body, including the length of the central tubular part 88*a* of the reverse-side plate 88. Therefore, the pressure parts 107, 107 of the interlocking member 68 can be inserted into the external tubular parts 86, 86. As a result, the interlocking member 68 prevents the pin member 66 from becoming misaligned or from falling out, and is firmly supported on the hinge half 79 on the side of the shooter main body.

The pin member 66 and the pin member 67 (FIG. 5) are common members. The interlocking member 68 is in contact with the ends 66*a*, 66*a* of the pin member 66. The interlocking member 69 is in contact with the ends 67*a*, 67*a* of the pin member 67. The interlocking member 68 and the interlocking member 69 are also common members.

Figure 7:
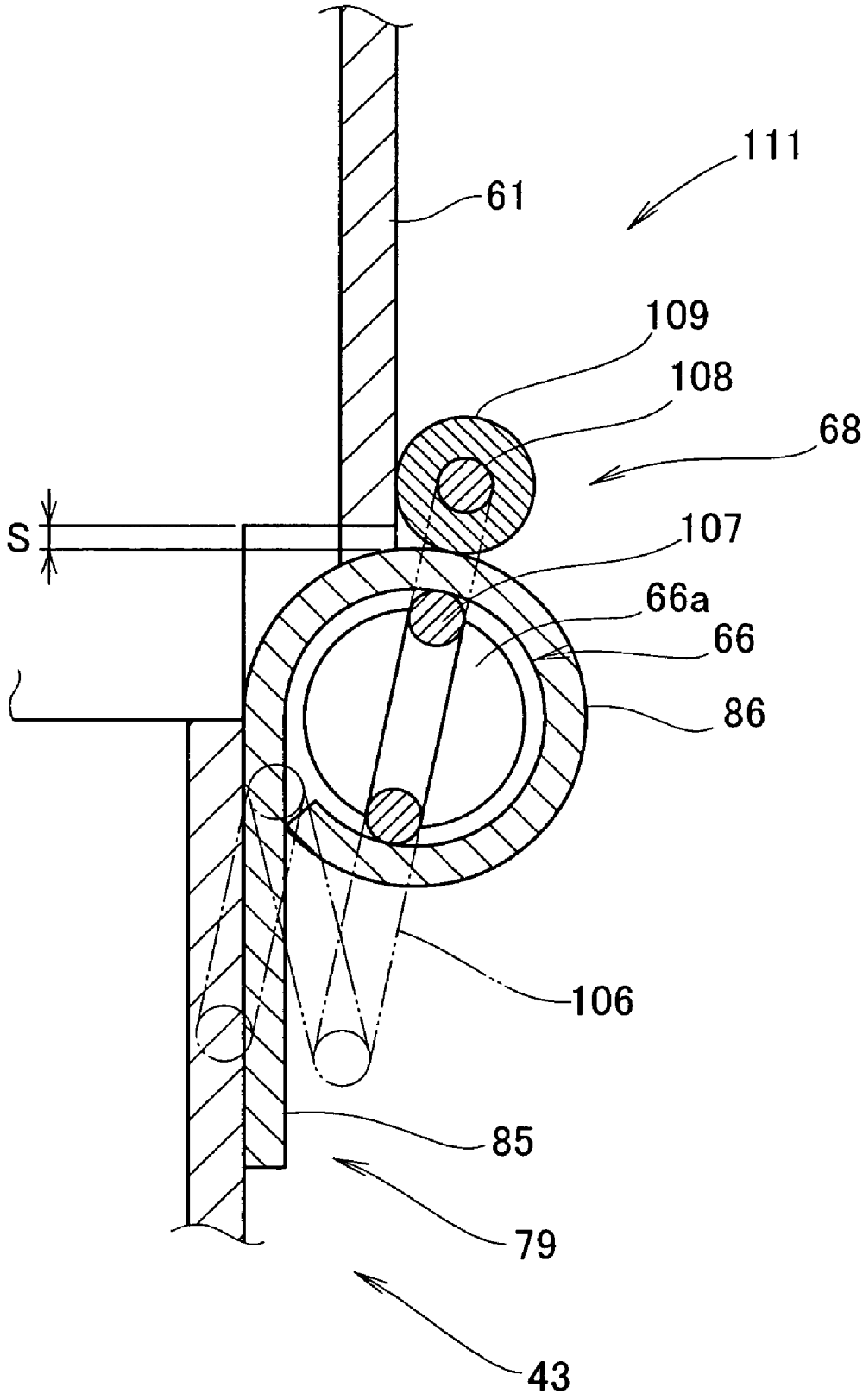
FIG. 7 is a cross-sectional view of a hinge and an interlocking member positioned between the shooter main body and the first shooter guide.

A gap S formed in the area where the shooter main body 43 and the first shooter guide 61 face each other is covered by the contact parts 108 of the interlocking member 68 as shown in FIG. 7, whereby the snow to be ejected is prevented from escaping to the exterior through the gap S.

The tubes 109 are more preferably mounted on the contact parts 108 because the gap S is then more effectively closed off. Therefore, the tubes 109 function as gap-filling members.

Figure 8:
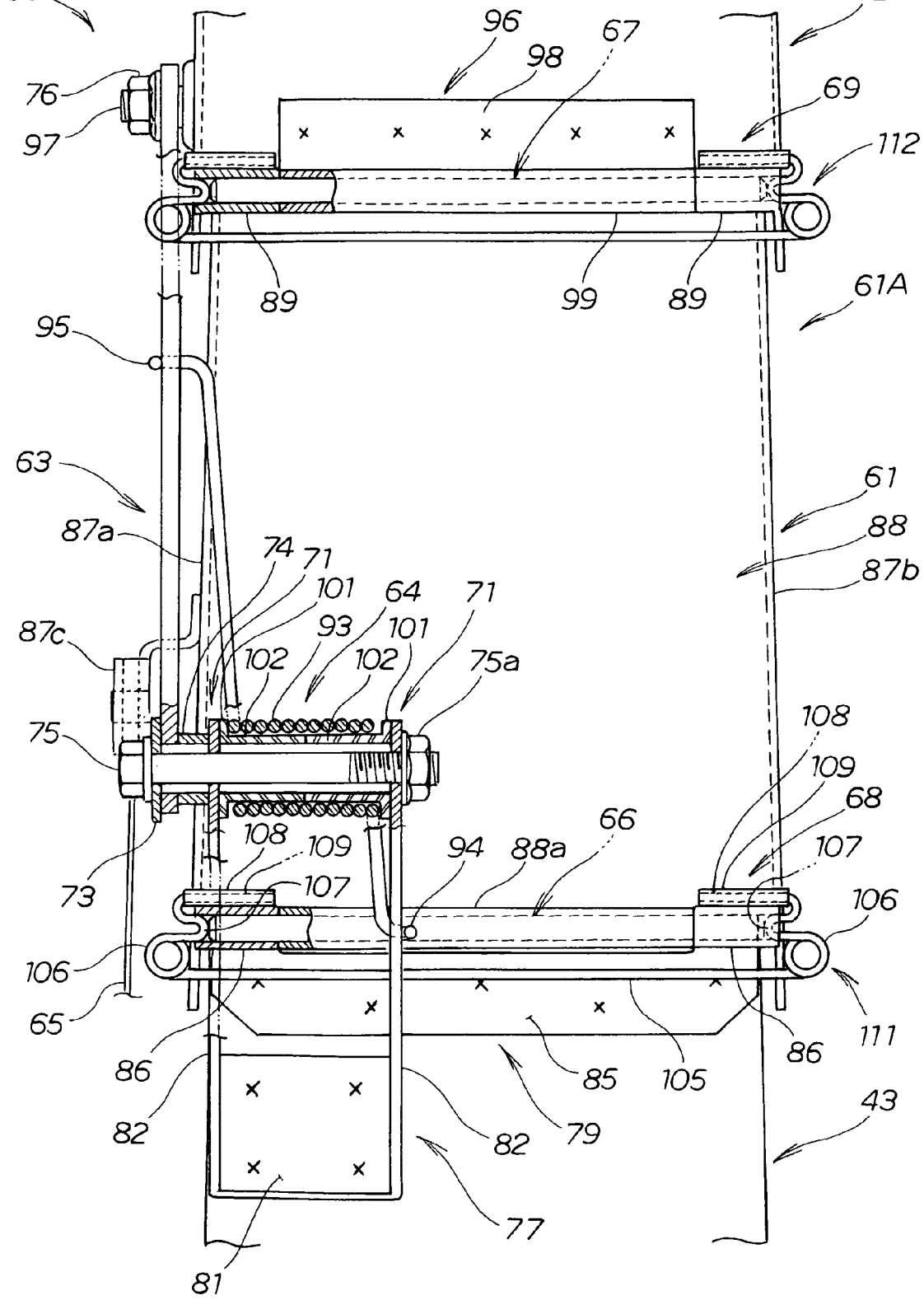
FIG. 8 is an enlarged partial cross-sectional view of the shooter shown in FIG. 4.

As shown in FIG. 8, the shooter 60 of the present invention is designed so that the torsion spring 64 located between the shooter main body 43 side and the shooter guide side is used as a means for returning the shooter guide 61A, and the collars (vibration-reducing members) 71, 71 are inserted into the coil 93. This reduces vibration in the torsion spring 64, and suppresses resonance in the torsion spring 64 that occurs with vibration in the engine 13 of the snow remover 10 shown in FIG. 1.

The coil 93 of the torsion spring 64 is located between the left and right-side parts 82, 82 of the bracket 77. As described above, the torsion spring 64 is mounted on the bracket 77 by passing the collars (vibration-reducing members) 71, 71 through the left- and right-side parts 82, 82 and inserting the collars into the coil 93. Therefore, deformation and vibration (resonance) in the radial direction of the torsion spring 64 are prevented.

The sequence for assembling the shooter 60 described above will now be described with reference to FIGS. 9A through 9D.

Figure 9B:
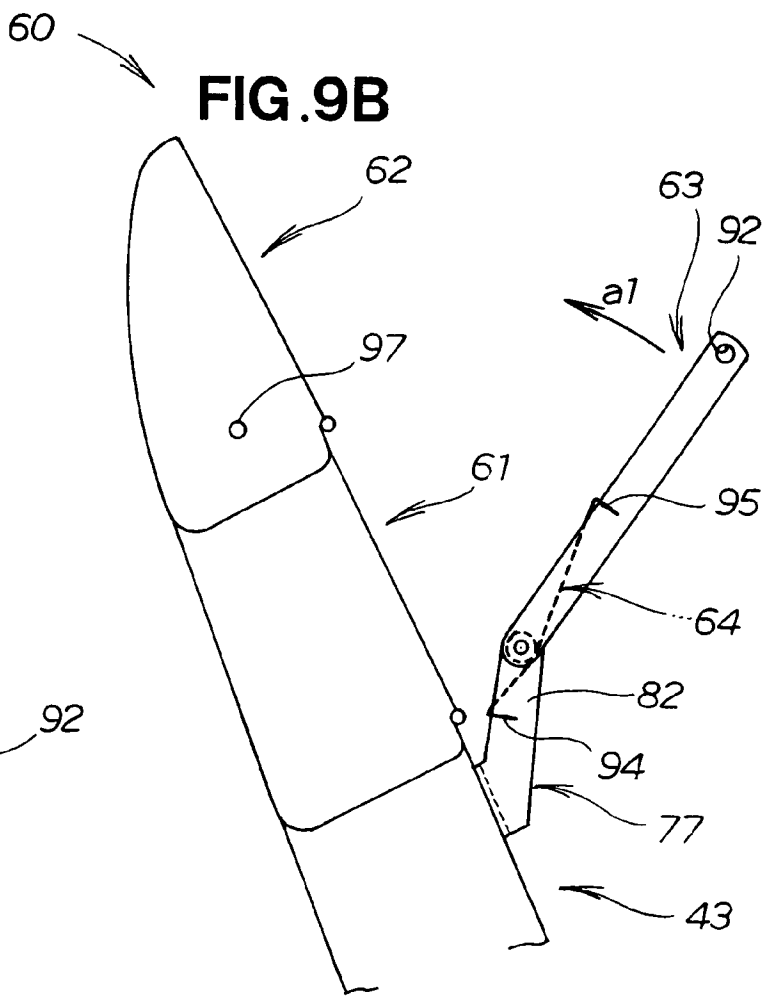
FIGS. 9A through 9D are diagrams showing the sequence of assembling the shooter.
Figure 9A:
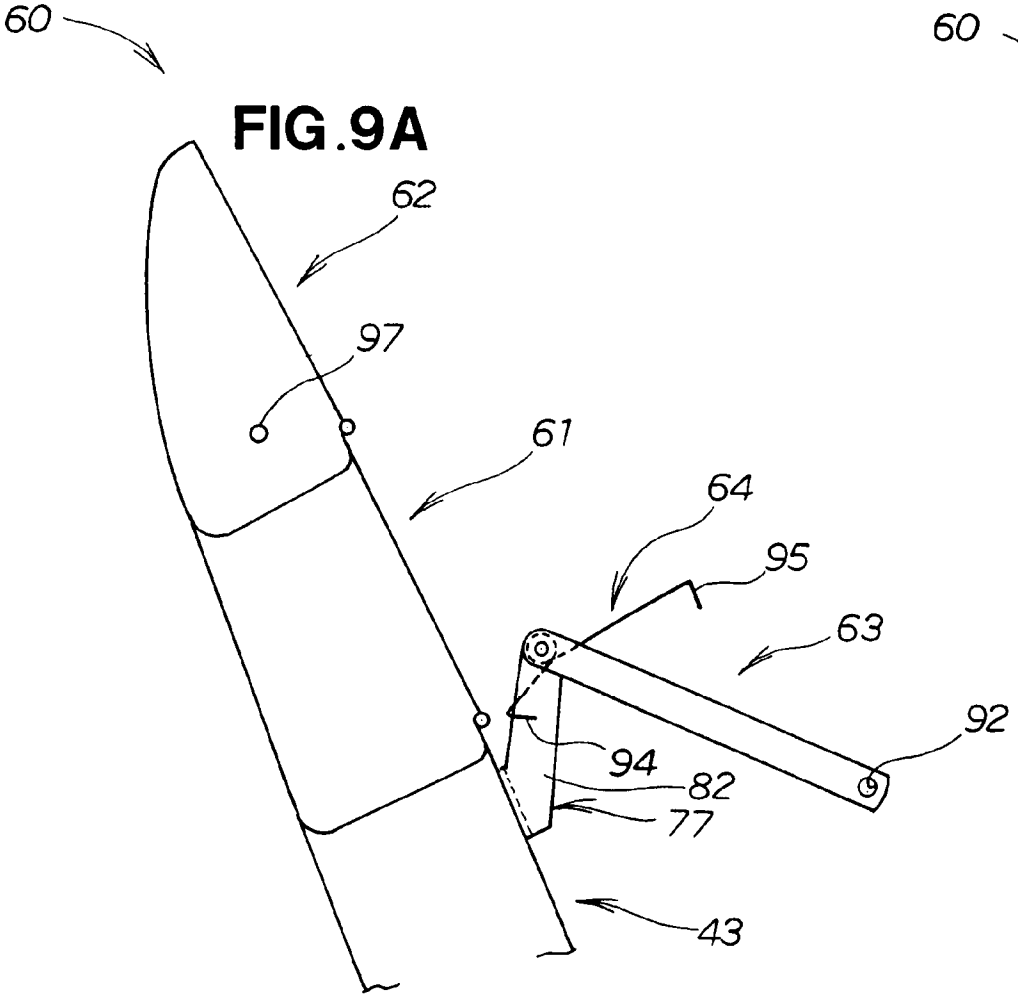

Referring to FIG. 9A, the first shooter guide 61 is first mounted on the shooter main body 43, the second shooter guide 62 is mounted on the first shooter guide 61, and the torsion spring 64 and one end of the plate link 63 are mounted on the bracket 77 of the shooter main body 43.

The interlocking part 94 of the torsion spring 64 is secured to the bracket 77, and the other interlocking part 95 is secured to the plate link 63, as shown in FIG. 9B. The plate link 63 is then rotated towards the shooter guide 61A, as shown by the arrow a1.

Figure 9D:
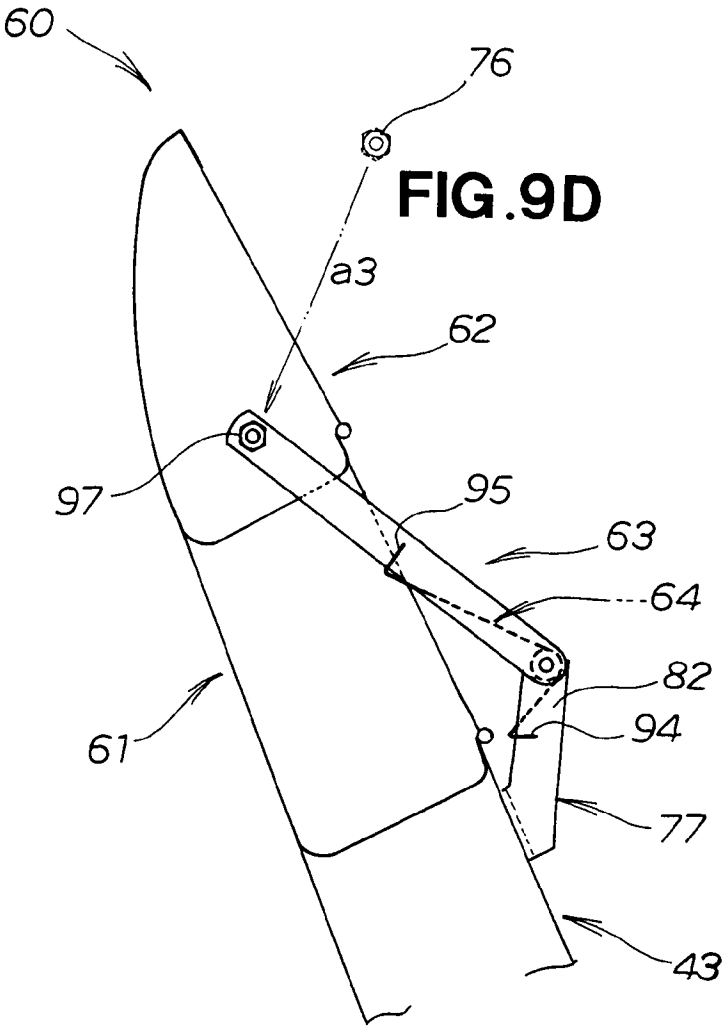
Figure 9C:
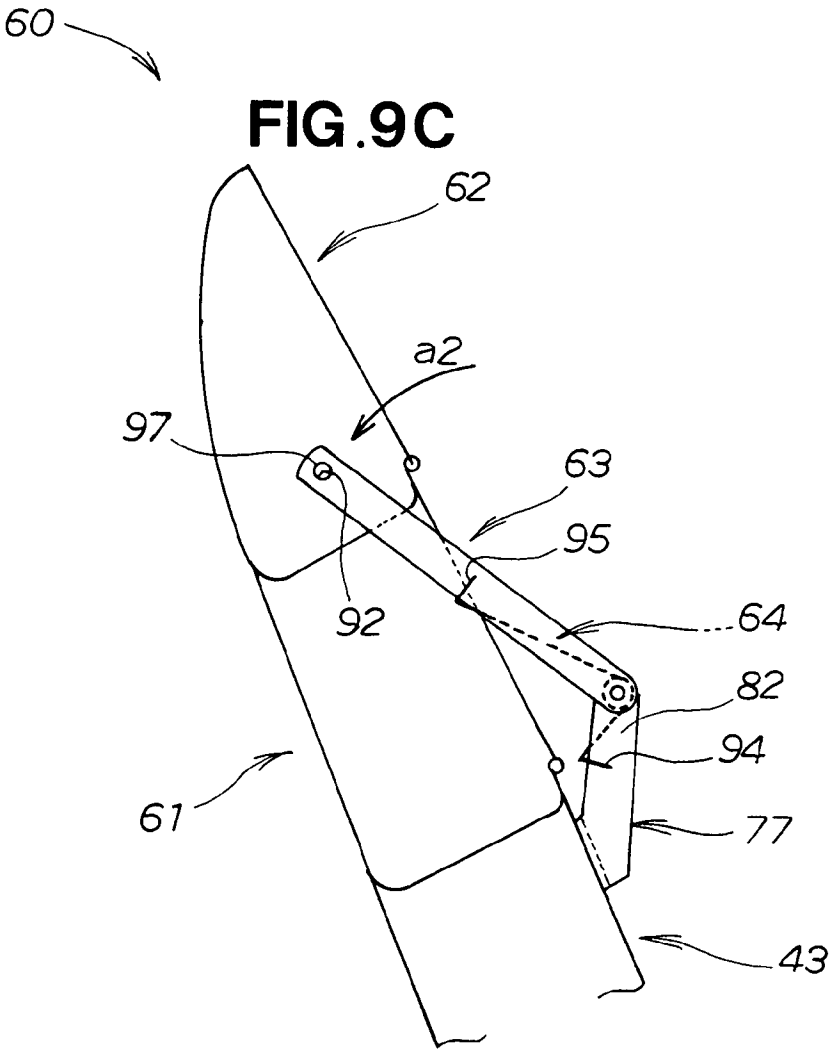

Next, the torsion spring 64 is bent by rotating the plate link 63 further as shown by the arrow a2, and a specific torque is applied to the torsion spring 64, as shown in FIG. 9C. The stud bolt 97 of the second shooter guide 62 is then fitted into the stud through-hole 92 of the plate link 63.

The unloaded torsion spring 64 is interposed between the bracket 77 and the plate link 63 in this manner, and the plate link 63 is then rotated and mounted on the second shooter guide 62. The torsion spring 64 is thereby easily mounted and the assembly of the shooter 60 is simplified.

Finally, as shown in FIG. 9D, the nut 76 is threaded over the stud bolt 97 as shown by the arrow a3, completing the assembly of the shooter 60.

Figure 10:
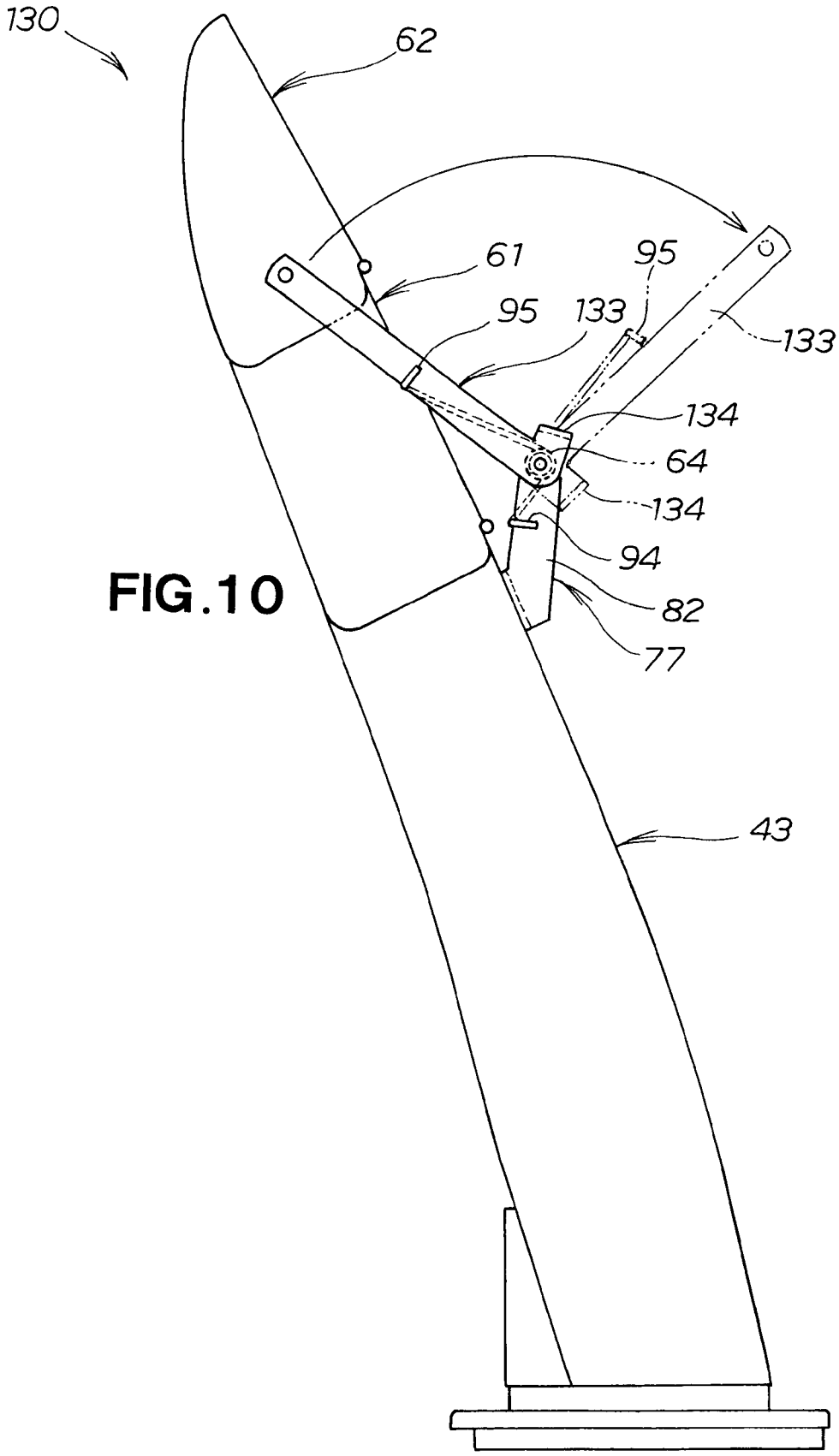
FIG. 10 is a side view of a shooter according to another embodiment of the present invention.

FIG. 10 shows a shooter 130 in another embodiment.

The shooter 130 of the other embodiment is different from the shooter of the first embodiment in the use of a plate link 133 obtained by improving the plate link 63 of the embodiment shown in FIGS. 3 through 8. Specifically, a stopper 134 is provided to one end of the plate link 133 so that the plate link 133 shown by the solid lines in FIG. 10 is detached from the second shooter guide 62, the torsion spring 64 reaches an unloaded state as shown by the double-dashed lines, and the other interlocking part 95 of the torsion spring 64 is detached from the plate link 133, whereupon the plate link 133 stops at a position in the vicinity of the other interlocking part 95, i.e., the plate link does not rotate downward. In other words, the plate link 133 is held in a fixed position because the stopper 134 engages with the side parts 82 of the bracket 77. When the other interlocking part 95 of the unloaded torsion spring 64 is engaged with the plate link 133, the stopper 134 prevents the plate link 133 from rotating towards the shooter main body 43. Therefore, the interlocking part 95 is easily engaged with the plate link 133 because the plate link 133 does not move and is positioned near the other interlocking part 95 of the torsion spring 64.

A shooter 140 of yet another embodiment will now be described with reference to FIG. 11. Components identical to those of the shooter 60 shown in FIG. 3 are denoted by the same reference numerals, and descriptions thereof are omitted.

Figure 11:
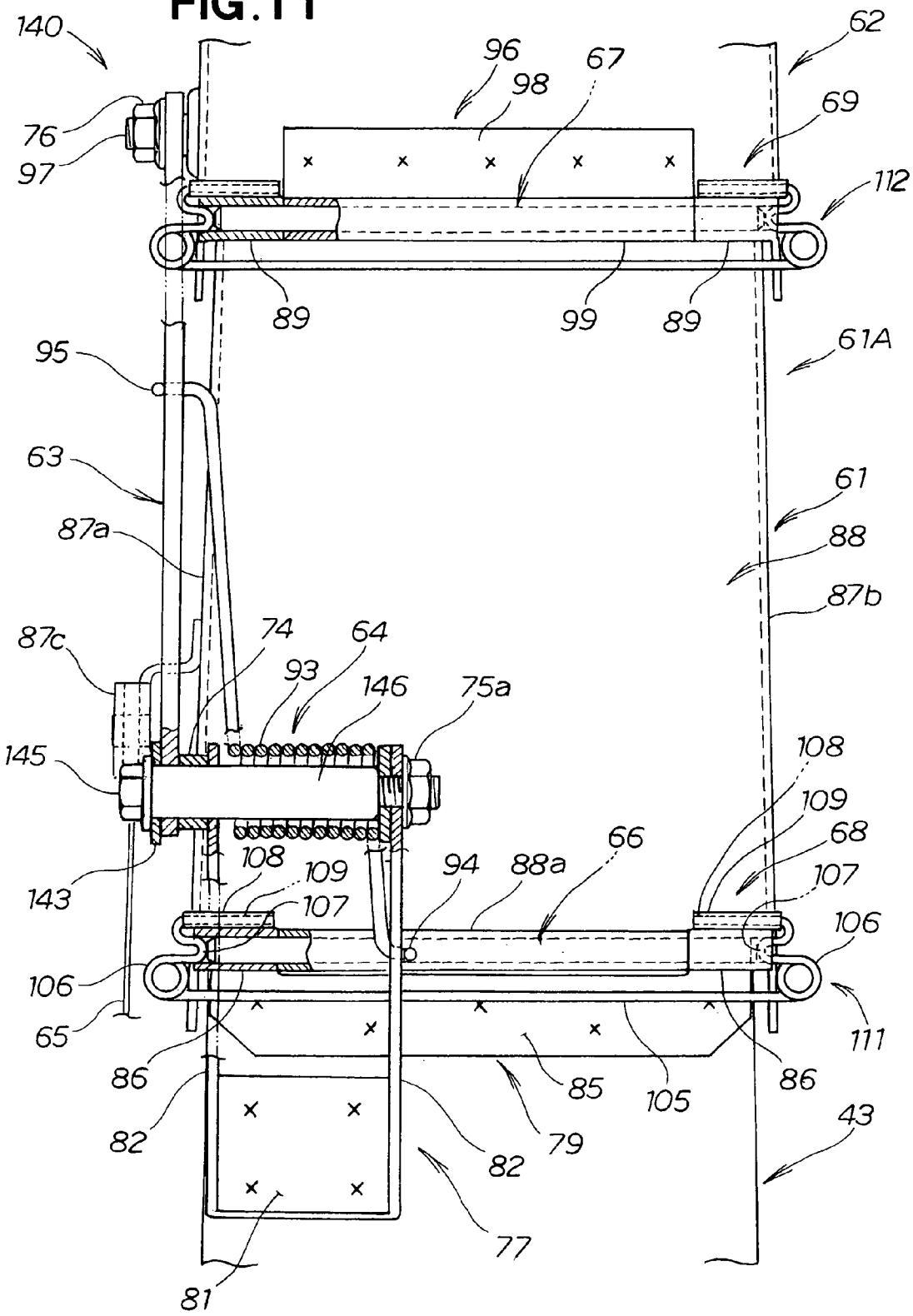
FIG. 11 is a partial cross-sectional view of a shooter apparatus according to yet another embodiment of the present invention.
Figure 12:
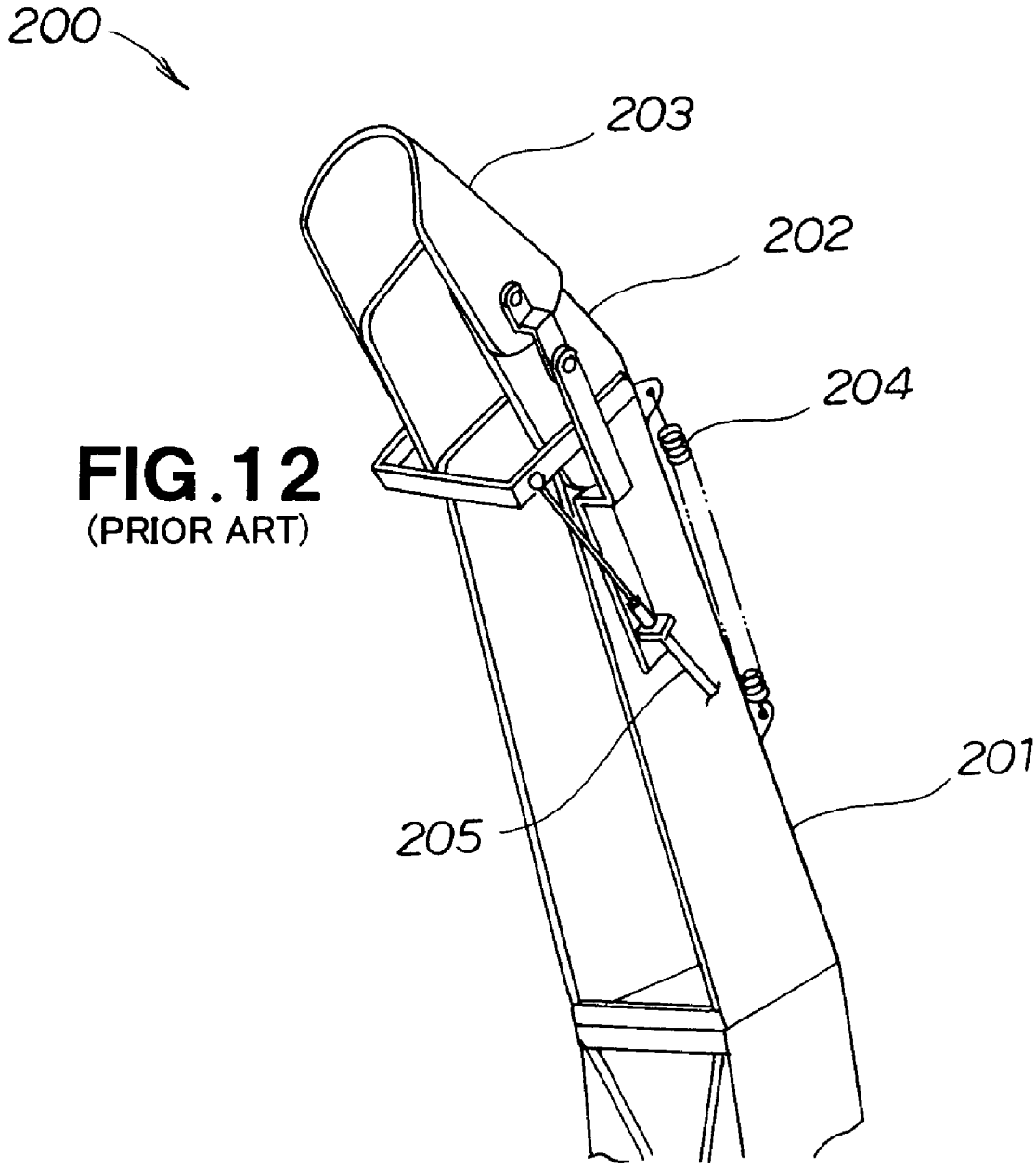
FIG.12 (PRIOR ART)
FIG. 12 is a perspective view showing a conventional shooter.

In the shooter 140 shown in FIG. 11, a bolt 145 has an integrated large-diameter stepped part 146. The vibration in the torsion spring 64 can be reduced by inserting the bolt 145 having the stepped part 146 through the coil 93 of the torsion spring 64. Specifically, the bolt 145 having the stepped part 146 is a vibration-reducing member that reduces vibration in the torsion spring 64.

In this other embodiment, an example was given in which the bolt 145 having a large-diameter stepped part 146 was used to reduce vibration in the torsion spring 64, but the present invention is not limited thereto, and a common bolt that does not have a large-diameter stepped part may be used. Furthermore, a resin, rubber, or the like may be mounted on a common bolt.

Obviously, various minor changes and modifications of the present invention are possible in light of the above teaching. It is therefore to be understood that within the scope of the appended claims the invention may be practiced otherwise than as specifically described.

What is claimed is:

1. A shooter for a snow remover, comprising:

a shooter main body configured to be rotatably mounted on an auger housing of a snow remover for ejecting snow collected by an auger of the snow remover;

a shooter guide swingably mounted on a top end of the shooter main body to undergo swinging movement from an initial state thereof so as to allow adjustment of an angle of projection of the snow ejected from the shooter main body;

a torsion spring connected between the shooter main body and the shooter guide for urging the shooter guide to return to the initial state thereof, the torsion spring having a single coil; and a plurality of vibration-reducing members inserted into the single coil of the torsion spring so as to be in physical contact with one another and to surround and support an entire inner periphery of the single coil for reducing vibration and deformation in a radial direction of the torsion spring, the vibration-reducing members comprising a first collar having a flange disposed in contact with a first end of the single coil and a tubular body inserted into the single coil via the first end thereof, and a second collar having a flange disposed in contact with a second end of the single coil and a tubular body inserted into the single coil via the second end thereof.

2. A shooter according to claim 1; wherein the shooter guide comprises:

a first shooter guide swingably mounted on the top end of the shooter main body;

a second shooter guide swingably mounted on a top end of the first shooter guide; and a plate link rotatably mounted on both the shooter main body and the second shooter guide.

3. A shooter according to claim 2; wherein the plate link is disposed on side surfaces of the shooter main body and the shooter guide.

4. A shooter according to claim 2; wherein the shooter main body has a bracket mounted on a top end thereof for mounting the torsion spring, the torsion spring having a first interlocking part interlocked with the bracket and a second interlocking part interlocked with the plate link.

5. A shooter according to claim 4; wherein the bracket is substantially U-shaped and has a bottom part and left- and right-side parts; and wherein the torsion spring is mounted on the bracket by inserting the vibration-reducing members through the left and right-side parts in a state in which the torsion spring is located between the left and right-side parts.

6. A shooter according to claim 4; wherein the plate link comprises a stopper for interlocking with the bracket such that the plate link is stopped at a position adjacent the second interlocking part of the torsion spring when the second interlocking part is disengaged from the plate link in a state in which the torsion spring is not loaded.

7. A shooter according to claim 1; wherein the vibration-reducing members are formed from a resin material.

8. A shooter according to claim 1; wherein the vibration-reducing members are formed from a rubber-based material.

9. A shooter according to claim 1; wherein the tubular bodies of the first and second collars are inserted into the single coil of the torsional spring so as to be contiguous with one another.

10. A shooter according to claim 1; further comprising a bracket having a pair of spaced-apart members mounted on the shooter main body; and further comprising connecting means for connecting the torsion spring between the spaced-apart members of the bracket.

11. A shooter according to claim 10; wherein the connecting means comprises a pair of through-holes formed in respective end portions of the spaced-apart members and a bolt extending through the through-holes and inserted into and supporting the first and second collars.

12. A shooter according to claim 11; wherein the tubular bodies of the first and second collars are inserted into the single coil of the torsional spring so as to be contiguous with one another.

13. A shooter according to claim 2; wherein the shooter main body has a bracket comprised of a pair of spaced-apart members for mounting the torsion spring; and wherein the plate link has a first end rotatably mounted on the second shooter guide and a second end rotatably mounted on one of the spaced-apart members of the bracket.

14. A shooter according to claim 4; wherein the bracket has a pair of spaced-apart members mounted on the shooter main body; and wherein the second interlocking part of the torsion spring is interlocked with one of the spaced-apart members of the bracket.

15. A shooter for ejecting snow, the shooter comprising:

a shooter main body;

a bracket comprised of a pair of spaced-apart members mounted on the shooter main body;

a shooter guide swingably mounted on the shooter main body to undergo swinging movement from an initial state thereof so as to allow adjustment of an angle of projection of the snow ejected from the shooter;

a plate link having a first end rotatably mounted to the shooter guide and a second end rotatably mounted to the bracket;

a torsion spring for urging the shooter guide to return to the initial state thereof, the torsion spring having a single coil mounted between the spaced-apart members of the bracket, a first interlocking part extending from a first end of the single coil and interlocked with the plate link, and a second interlocking part extending from a second end of the single coil opposite the first end thereof and interlocked with one of the spaced-apart members of the bracket; and a plurality of vibration-reducing members extending into the single coil of the torsion spring so as to be in physical contact with one another and to surround and support an entire inner periphery of the single coil for reducing vibration and deformation in a radial direction of the torsion spring, the vibration-reducing members comprising a first collar having a flange disposed in contact with the first end of the single coil and a tubular body inserted into the single coil via the first end thereof, and a second collar having a flange disposed in contact with the second end of the single coil and a tubular body inserted into the single coil via the second end thereof.

16. A shooter according to claim 15; wherein the spaced-apart members of the bracket are parallel to one another.

17. A shooter according to claim 15; wherein the tubular bodies of the first and second collars are inserted into the single coil of the torsional spring so as to be contiguous with one another.

18. A shooter according to claim 15; wherein the spaced-apart members of the bracket have a pair of aligned through-holes; and further comprising a bolt extending through the aligned through-holes of the spaced-apart members and extending through and supporting the first and second collars of the vibration-reducing members.

19. A shooter according to claim 15; wherein the vibration-reducing members are formed from one of a resin-based material and a rubber-based material.

20. A shooter according to claim 15; wherein the plate link comprises a stopper for interlocking with the bracket such that the plate link is stopped at a position adjacent the second interlocking part of the torsion spring when the second interlocking part is disengaged from the plate link in a state in which the torsion spring is not loaded.

21. A shooter according to claim 10; wherein the connecting means connects the torsion spring between the spaced-apart members of the bracket so that the spaced-apart members abut the respective flanges of the first and second collars.

22. A shooter according to claim 15; further comprising connecting means for connecting the torsion spring between the spaced-apart members of the bracket so that the spaced-apart members abut the respective flanges of the first and second collars.

* * * * *